US008038485B2

(12) United States Patent
Sykes et al.

(10) Patent No.: US 8,038,485 B2
(45) Date of Patent: Oct. 18, 2011

(54) ELECTRICAL CONNECTOR HAVING CONTACTS SECURED IN A HOUSING BODY

(75) Inventors: Michael Timothy Sykes, Harrisburg, PA (US); Donald E. Wood, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 57 days.

(21) Appl. No.: 12/506,835

(22) Filed: Jul. 21, 2009

(65) Prior Publication Data

US 2011/0021062 A1 Jan. 27, 2011

(51) Int. Cl.
*H01R 13/40* (2006.01)

(52) U.S. Cl. ..... 439/733.1; 439/752

(58) Field of Classification Search ..... 439/733.1, 439/444, 752

See application file for complete search history.

(56) References Cited

U.S. PATENT DOCUMENTS

| | | | | | |
|---|---|---|---|---|---|
| 3,448,345 | A | * | 6/1969 | Shrock et al. | 361/791 |
| 3,917,375 | A | * | 11/1975 | Johnson | 439/487 |
| 4,660,911 | A | * | 4/1987 | Reynolds et al. | 439/83 |
| 4,906,212 | A | * | 3/1990 | Mixon, Jr. | 439/857 |
| 4,966,557 | A | * | 10/1990 | Barkus et al. | 439/246 |
| 5,007,862 | A | * | 4/1991 | Defibaugh et al. | 439/607.59 |
| 5,067,916 | A | * | 11/1991 | Denlinger et al. | 439/857 |
| 5,591,035 | A | * | 1/1997 | Burkholder et al. | 439/79 |
| 5,779,489 | A | * | 7/1998 | Davis et al. | 439/79 |
| 6,012,954 | A | * | 1/2000 | Wu | 439/752 |
| 6,102,711 | A | * | 8/2000 | Hanada et al. | 439/70 |

FOREIGN PATENT DOCUMENTS

EP 0144128 * 12/1985

OTHER PUBLICATIONS

Advanced TCA Connectors acc. To PICMG 3.0; ERNI; www.emi.com; 8 pgs.

Advanced TCA™; PICMG 3.0 Short Form Specification; Jan. 2003; Copyright 2003, PCI Industrial Computers Manufacturers Group (PICMG); 34 pgs.

* cited by examiner

*Primary Examiner* — Neil Abrams

(57) ABSTRACT

An electrical connector includes a unitary housing body and a stamped and formed contact. The housing extends from a mounting side to an opposite mating side. The housing body includes a cavity extending through the housing body from the mounting side to the mating side, a contact slot, and a chamfered lead-in ramp disposed at the mating side to guide the contact pin into the cavity. The contact is held in the cavity and extends between a mating segment and a mounting segment. The mating segment is configured to receive the contact pin of the mating connector. The mounting segment is configured to mount the contact to a circuit board and includes a shoulder that is disposed proximate to the mounting side of the housing body. The shoulder engages the housing body in the contact slot to secure the contact in the housing body. A retention insert may be loaded through the mounting side into the cavity to help retain the contact in the housing and may include bumps on opposite sides to provide an interference fit in the cavity.

19 Claims, 4 Drawing Sheets

ELECTRICAL CONNECTOR HAVING CONTACTS SECURED IN A HOUSING BODY

BACKGROUND OF THE INVENTION

The subject matter herein relates generally to electrical connectors and, more particularly, to connectors that include contacts secured in a housing body.

Known electrical connectors include housing bodies that hold contacts. The housing bodies and contacts may be mounted or joined to a circuit board or other device to electrically couple the connector with the circuit board or device. The contacts also may be mated with the contacts of a mating connector to electrically couple the connector and mating connector with one another. Some known connectors include cavities in which the contacts are disposed. The contacts may be receptacle contacts that receive contact pins of the mating connector to electrically couple the receptacle contacts with the contact pins. If the pin contacts are not aligned with the receptacle contacts in the housing body, however, the pin contacts may stub on the ends of the receptacle contacts. For example, instead of receiving the pin contacts into the receptacle contacts, the misaligned pin contacts may stub on the receptacle contacts. In order to provide receptacle contacts that are strong enough to withstand the stubbing of pin contacts on the receptacle contacts, some known receptacle contacts are formed by screw machining the contacts from a solid block of a metal or metal alloy. Screw machining contacts can be a relatively expensive manufacturing process.

Other known connectors include contacts that are stamped and formed from a common sheet of a conductive material. For example, some other known contacts are stamped and formed from a metal sheet. But, stamped and formed contacts may be unsuitable for use as receptacle contacts because the stamped and formed contacts are weaker than screw machined contacts and are more likely to bend or fail when a contact pin stubs on the stamped and formed contact.

A need exists for connectors having contacts that are less expensive to manufacture than some known screw machined contacts and that prevent the contact pins of a mating connector from stubbing on the contacts and causing the contacts to bend or fail.

BRIEF DESCRIPTION OF THE INVENTION

In one embodiment, an electrical connector is provided. The connector includes a unitary housing body and a stamped and formed contact. The housing extends from a mounting side to an opposite mating side. The mating side is configured to receive a contact pin of a mating connector through the mating side. The housing body includes a cavity extending through the housing body from the mounting side to the mating side, a contact slot disposed at the mounting side, and a chamfered lead-in ramp disposed at the mating side to guide the contact pin into the cavity. The contact is held in the cavity and extends between a mating segment and a mounting segment along a longitudinal axis. The mating segment is configured to receive the contact pin of the mating connector. The mounting segment is configured to mount the contact to a circuit board and includes a shoulder that is disposed proximate to the mounting side of the housing body. The shoulder engages the housing body in the contact slot to secure the contact in the housing body. Optionally, the housing body is a single piece body that is molded from a dielectric material. The cavity may be staged in diameter to form a plurality of stages between the mounting side and the mating side, and, for each pair of stages that are adjacent to one another, an inside diameter of a first stage located closer to the mating side is less than an inside diameter of a second stage located closer to the mounting side. In one embodiment, the lead-in ramp circumferentially surrounds the cavity at the mating side.

In another embodiment, another electrical connector is provided. The connector includes a housing body, a cavity and a contact. The housing body extends from a mounting side to an opposite mating side. The mating side is configured to receive a contact pin of a mating connector through the mating side. The housing body includes a chamfered lead-in ramp that is disposed at the mating side. The cavity extends through the housing body from the mating side to the mounting side and is aligned with the lead-in ramp. The cavity is staged in diameter to form a plurality of stages between the mounting side and the mating side such that, for each pair of the stages that are adjacent to one another, an inside diameter of a first stage located closer to the mating side is less than an inside diameter of a second stage located closer to the mounting side. The contact is held in the cavity. The lead-in ramp guides the contact pin toward and into the contact to mate the contact with the contact pin.

DETAILED DESCRIPTION OF THE INVENTION

Figure 1:
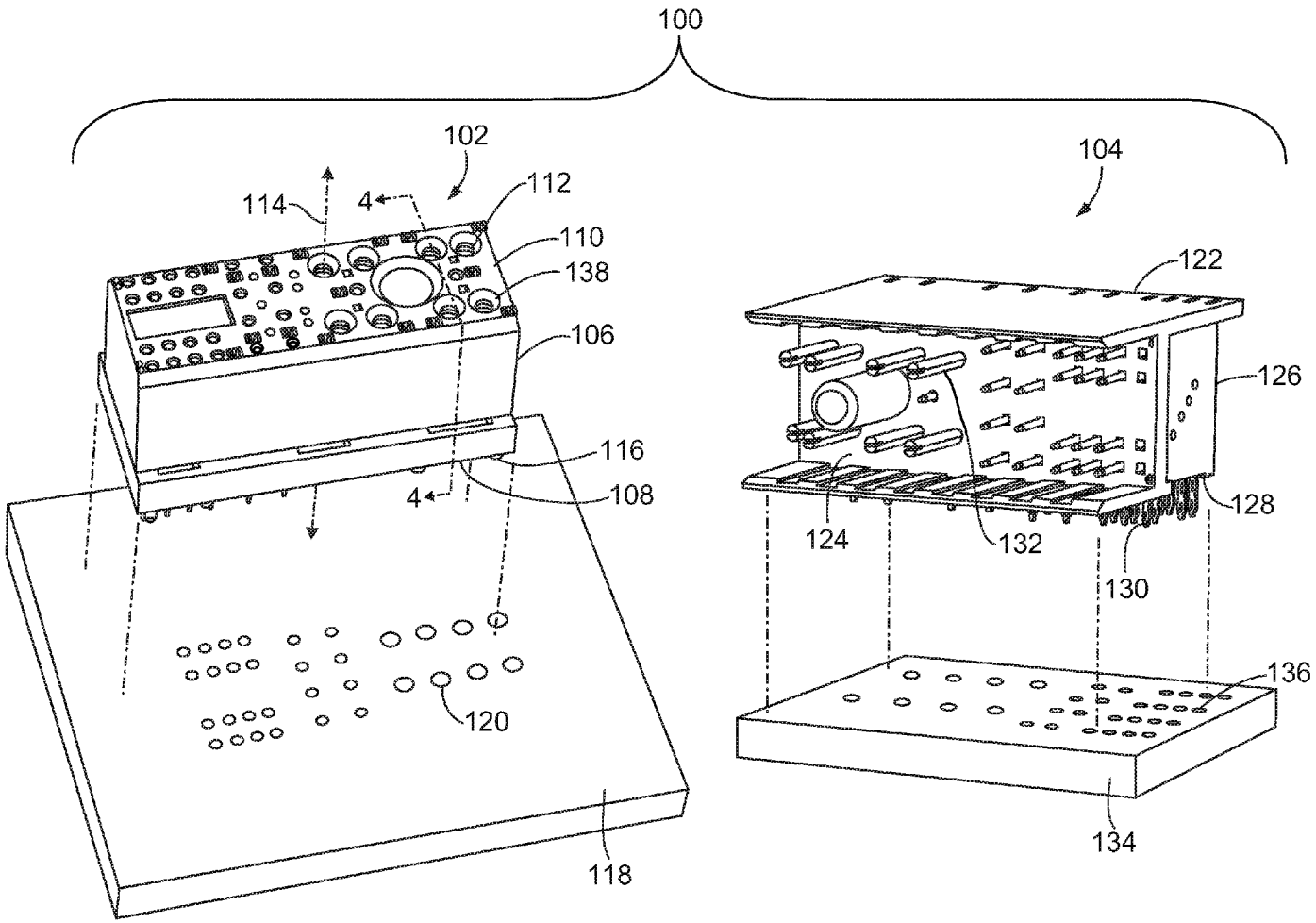
FIG. 1 is a perspective view of an electrical connector system in accordance with one embodiment.

FIG. 1 is a perspective view of an electrical connector system 100 in accordance with one embodiment. The connector system 100 includes a mounting connector 102 and a mating connector 104. In the illustrated embodiment, the mounting and mating connectors 102, 104 are Advanced Telecom Computing Architecture (ATCA) connectors. The scope of the disclosed embodiments is not, however, limited to ATCA connectors. One or more embodiments may encompass connectors other than ATCA connectors and the illustration and description herein of ATCA connectors should not be construed as a limitation on the scope of all embodiments.

The mounting connector 102 includes a housing body 106 that is mounted to a circuit board 118. The housing body 106 may be formed as a unitary body. For example, the housing body 106 may be a single piece body that is molded or otherwise formed from a dielectric material. The housing body 106 has a mounting side 108 and an opposite mating side 110. The mounting side 108 engages the circuit board 118 when the mounting connector 102 is mounted thereto. Several cavities 112 extend through the housing body 106 from the mating side 110 to the mounting side 108 along corresponding center axes 114. In the illustrated embodiment, the cavities 112 include chamfered lead-in ramps 138 that are axially aligned with the cavities 112 along the center axes 114. The lead-in ramps 138 may extend around the periphery of the cavities 112 at the mating side 110. For example, the lead-in ramps 138 may circumferentially surround the cavities 112 at the mating side 110. Contacts 200 (shown in FIG. 2) are held in the cavities 112 and protrude out of the cavities 112 from the mounting side 108. The contacts 200 include mounting ends 116 that are received in holes 120 in the circuit board 118 to electrically couple the mounting connector 102 with the circuit board 118.

The mating connector 104 includes a housing body 122 that extends between a front side 124 and a back side 126. A mounting side 128 intersects both the front side 124 and the back side 126 in the illustrated embodiment. Several contacts 130 are held in the housing body 122 and extend between the mounting side 128 and the front side 124. The contacts 130 protrude from the mounting side 128 and include contact pins 132 that protrude from the front side 124. The mounting side 128 is mounted to another circuit board 134 and the contacts 130 are received in holes 136 of the circuit board 134 to electrically couple the mating connector 104 with the circuit board 134.

The mating connector 104 mates with the mounting connector 102 to electrically couple the mating and mounting connectors 104, 102 and to electrically interconnect the circuit board 118 with the circuit board 134. The front side 124 of the mating connector 104 engages the mating side 110 of the mounting connector 102. The contact pins 132 are received in the mating side 110 and into the cavities 112 to engage the contacts 200 (shown in FIG. 2) in the cavities 112. The contact pins 132 may engage the lead-in ramps 138 of the housing body 106 as the contact pins 132 are inserted into the cavities 112. The lead-in ramps 138 guide the contact pins 132 toward engagement with the contacts 200 in the cavities 112.

Figure 2:
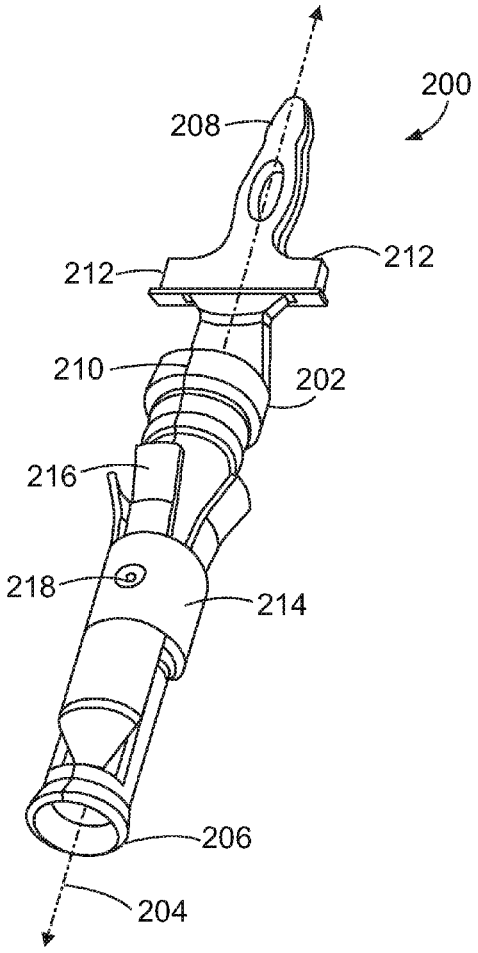
FIG. 2 is a perspective view of a contact that is disposed in a mounting connector shown in FIG. 1 in accordance with one embodiment.
Figure 3:
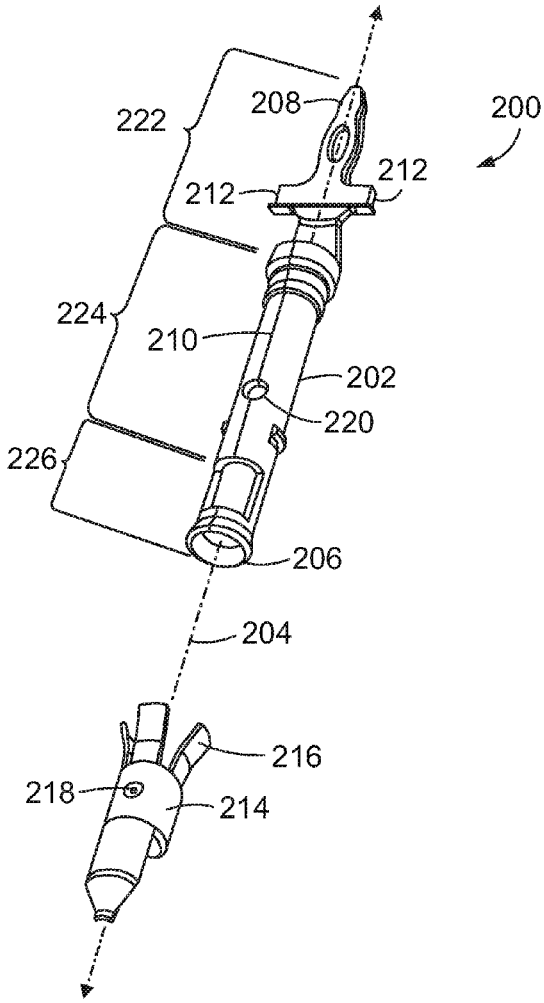
FIG. 3 is an exploded view of the contact shown in FIG. 2 in accordance with one embodiment.

FIG. 2 is a perspective view of one of the contacts 200 that is disposed in the mounting connector 102 in accordance with one embodiment. FIG. 3 is an exploded view of the contact 200 in accordance with one embodiment. The contact 200 is a stamped and formed contact. For example, the contact 200 may be stamped and formed from a common sheet of conductive material, such as a metal sheet. Alternatively, the contact 200 may include, or be formed from a dielectric material and include a conductive plating on at least a portion of the surface of the contact 200. The contact 200 includes an elongated body 202 that extends between a mating end 206 and a mounting end 208 and is oriented along a longitudinal axis 204. The body 202 includes a mounting segment 222, a middle segment 224 and a mating segment 226. The mounting segment 222 is interconnected with the mating segment 226 by the middle segment 224. The mounting segment 222 and mating segment 226 are disposed on opposite ends of the contact 200 along the longitudinal axis 204. The mounting segment 222 includes the mounting end 208 and the mating segment 226 includes the mating end 206.

The body 202 extends through the mating and middle segments 226, 224 along the longitudinal axis 204. The body 202 is bent around the longitudinal axis 204 and includes a seam 210 disposed approximately parallel to the longitudinal axis 204 and extending along the length of the body 202. One or more portions of the body 202 may be selectively plated with a conductive material. For example, the mating segment 226 may be plated with gold, a gold alloy, or another metal or metal alloy.

The body 202 is formed as a hollow, approximately tubular body that encircles the longitudinal axis 204 along a length of the body 202. The mating end 206 forms an approximately circular opening around the longitudinal axis 204. The mating end 206 is disposed below the mating side 110 (shown in FIG. 1) of the mounting connector 102 (shown in FIG. 1) with the longitudinal axis 204 of the contact 200 oriented approximately parallel to the center axis 114 (shown in FIG. 1) of the cavity 112. The mating end 206 receives the contact pin 132 (shown in FIG. 1) of the contact 130 (shown in FIG. 1) to electrically couple the contact 200 with the contact 130. As described above, the lead-in ramp 138 (shown in FIG. 1) of the mounting connector 102 guides the contact pin 132 toward and into the opening formed by the mating end 206 of the contact 200. The lead-in ramp 138 may guide the contact pin 132 toward the longitudinal axis 204 of the contact 200 and into the body 202 of the contact 200 to avoid stubbing the contact pin 132 on the mating end 206.

In the illustrated embodiment, the mounting segment 222 includes an eye-of-needle (EON) pin and shoulders 212. The pin is received in the circuit board 118 (shown in FIG. 1) to secure the contact 200 to the circuit board 118. The shoulders 212 extend from the contact 200 in opposite directions. A different number of shoulders 212 may be provided than the pair of shoulders 212 in the illustrated embodiment. The shoulders 212 may extend from the contact 200 in directions that are approximately perpendicular to the longitudinal axis 204.

The contact 200 includes a retention element 214 that is disposed proximate to the mating end 206. For example, the retention element 214 may be secured to the body 202 in the middle segment 224 of the contact 200. Alternatively, the contact 200 does not include the retention element 214. In the illustrated embodiment, the retention element 214 is located between the mating end 206 and the mounting end 208 but is disposed closer to the mating end 206 than the mounting end 208. The retention element 214 is formed separately from the body 202. For example, the retention element 214 and body 202 do not form a single, unitary body in the illustrated embodiment. Alternatively, the retention element 214 and body 202 may be formed as a single, unitary body. The retention element 214 may be stamped and formed from a common sheet of conductive material, such as a metal or metal alloy. In another embodiment, the retention element 214 may include, or be formed from, a dielectric material.

The retention element 214 includes outwardly angled centering tines 216 that extend from the retention element 214 at an angle with respect to the longitudinal axis 204. As described below, the centering tines 216 engage the inner walls 410 (shown in FIG. 4) of the cavities 112 (shown in FIG. 1) to center the contacts 200 in the cavities 112. In one embodiment, the centering tines 216 may assist in securing the contact 200 in the mounting connector 102. The retention element 214 includes a protrusion 218 that extends inwards toward the longitudinal axis 204 of the contact 200. The protrusion 218 is received into an opening 220 of the body 202 of the contact 200 to secure the retention element 214 to the body 202.

Figure 4:
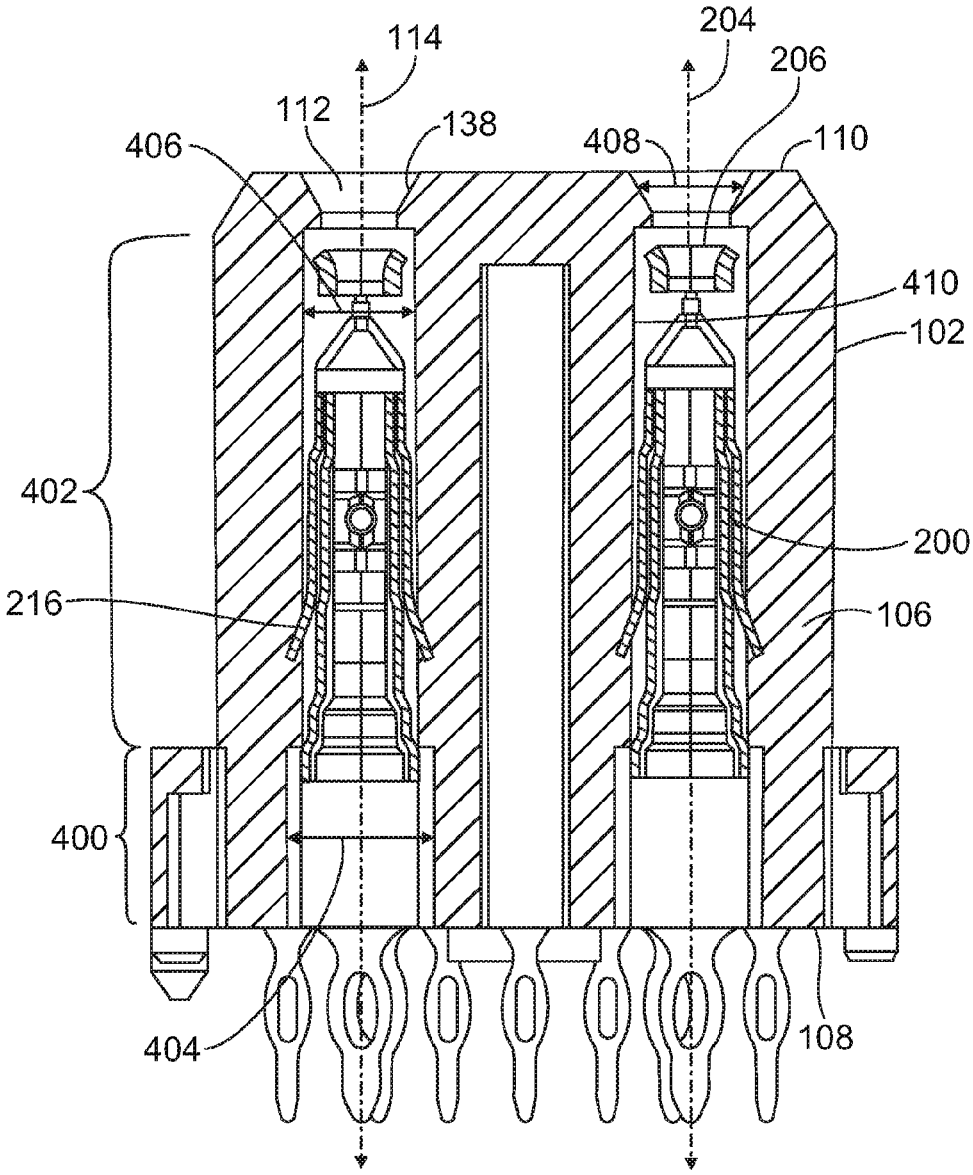
FIG. 4 is a cross-sectional view of the mounting connector shown in FIG. 1 taken along line 4-4 in FIG. 1 in accordance with one embodiment.

FIG. 4 is a cross-sectional view of the mounting connector 102 taken along line 4-4 in FIG. 1 in accordance with one embodiment. As shown in FIG. 4, the cavities 112 include inner walls 410 that are staged in diameter to form several stages 400, 402 between the mounting side 108 and the mating side 110 of the mounting connector 102. In the illustrated embodiment, the lower stage 400 includes a larger inside diameter 404 than an inside diameter 406 of the upper stage 402. The cavities 112 may include a different number of stages 400, 402. For example, the cavities 112 may include a single stage having an approximately constant diameter between the mounting side 108 and the mating side 110.

Alternatively, the cavities 112, may have a greater number of stages. In one embodiment, the cavities 112 are shaped such that for each pair of adjacent stages, the inside diameter of the stage that is closer to the mating side 110 is smaller than the inside diameter of the stage that is closer to the mounting side 108. For example, the stages may be arranged such that the inside diameter of the stages increases in each subsequent stage starting at the stage that is closest to the mating side 110 and ending with the stage that is the closest to the mounting side 108. In another embodiment, the cavities 112 are shaped such that for each pair of adjacent stages, the inside diameter of the stage that is closer to the mating side 110 is larger than the inside diameter of the stage that is closer to the mounting side 108. The stages 400, 402 may be arranged in such a manner because the housing body 106 of the mounting connector 102 is a single piece molded body. Such a body may be unable to have a cavity that has a smaller or larger inside diameter in a first stage than the inside diameters of the two stages that are directly adjacent to the first stage due to geometric limitations of the mold in which the housing body 106 is formed.

The centering tines 216 of the contact 200 engage the inner walls 410 of the cavity 112 to center the contact 200 in the cavity 112. For example, the centering tines 216 may directly contact the inner walls 410 to axially center the contact 200 such that the longitudinal axis 204 of the contact 200 is approximately aligned with the center axis 114 of the cavity 112. In one embodiment, the centering tines 216 axially center the contact 200 such that the longitudinal axis 204 of the contact 200 and the center axis 114 of the cavity 112 are substantially coextensive. Centering the contact 200 in the cavity 112 may prevent the contact pin 132 (shown in FIG. 1) from stubbing on the mating end 206 of the contact 200. In one embodiment, the centering tines 216 engage the inner walls 410 of the cavity 112 to help secure the contact 200 in the cavity 112. The retention tines 216 may impart a frictional force on the inner walls 410 to prevent or impede removal of the contact 200 through the mounting side 108 of the mounting connector 102. For example, the centering tines 216 may secure the contact 200 in the cavity 112 by an interference fit between the centering tines 216 and the inner walls 410.

The contacts 200 are disposed in the cavities 112 such that the mating ends 206 of the contacts 200 are recessed into the body 106 below the mating side 110 of the mounting connector 102. As shown in FIG. 4, the lead-in ramp 138 includes a ramped surface that is angled toward the center axis 114 of the cavity 112. For example, an inside diameter 408 of the lead-in ramp 138 may be largest at the mating side 110 and may decrease in size along the center axis 114 of the cavity 112. The lead-in ramp 138 is angled toward the center axis 114 in order to guide the contact pin 132 (shown in FIG. 1) of the mating connector 104 (shown in FIG. 1) toward the contact 200. The lead-in ramp 138 guides the contact pin 132 to avoid the contact pin 132 stubbing on the mating end 206 of the contact 200. For example, if the contact pin 132 is misaligned with the longitudinal axis 204 when the contact pin 132 is inserted into the cavity 112, the contact pin 132 may engage the lead-in ramp 138. The contact pin 132 may move along the angled lead-in ramp 138 as the contact pin 132 is inserted into the cavity 112. The lead-in ramp 138 guides the contact pin 132 toward the center axis 112 of the cavity 112 and/or the longitudinal axis 204 of the contact 200 to enable the mating end 206 to receive the contact pin 132 without the contact pin 132 stubbing on the mating end 206.

Figure 5:
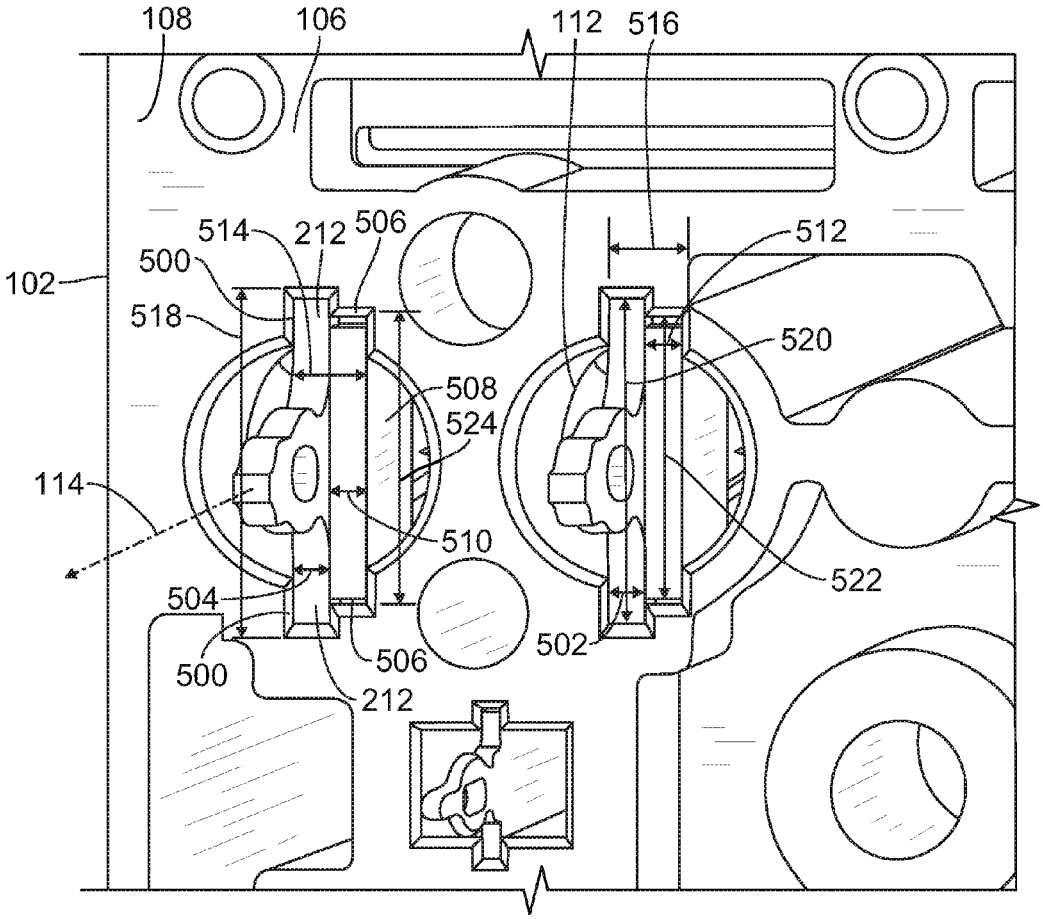
FIG. 5 is a perspective view of a portion of a mounting side shown in FIG. 1 of the mounting connector that also is shown in FIG. 1 in accordance with one embodiment.

FIG. 5 is a perspective view of a portion of the mounting side 108 of the mounting connector 102 in accordance with one embodiment. The cavities 112 include contact slots 500 that receive the shoulders 212 of the contacts 200. The contact slots 500 may have a thickness dimension 502 that is approximately the same as, or smaller than, a thickness dimension 504 of the shoulders 212. For example, the contact slots 500 may be slightly narrower than the shoulders 212 in order to provide an interference fit between the shoulders 212 and the mounting connector 102 in a location that is at or proximate to the mounting side 108. In one embodiment, a width dimension 518 of the contact slots 500 is approximately the same as, or smaller than, a width dimension 520 of the shoulders 512. The contact slots 500 may be slightly smaller in width than the shoulders 212 in order to provide or contribute to an interference fit between the shoulders 212 and the mounting connector 102 in a location that is at or proximate to the mounting side 108. For example, the interference fit between the shoulders 212 and the housing body 106 of the mounting connector 102 may be located in a position that is closer to the mounting side 108 than the mating side 110 (shown in FIG. 1) of the mounting connector 102.

In the illustrated embodiment, the cavities 112 include offset slots 506 that are disposed next to the contact slots 500. For example, the offset slots 506 may be directly adjacent to the contact slots 500. The offset slots 506 are disposed to one side of the center axis 114 of the cavities 112 with the contact slots 500 being disposed along the center axis 114 such that the center axis 114 extends through the contact slots 500 but does not extend through the offset slots 506. A retention insert 508 is loaded into the offset slots 506 to increase the interference fit between the shoulders 212 and the mounting connector 102. The retention insert 508 may be a body that has a thickness dimension 510 that is greater than a thickness dimension 512 of the offset slots 506. In one embodiment, the retention insert 508 has a width dimension 522 that is greater than a width dimension 524 of the offset slots 506. The retention insert 508 is a rigid or semi-rigid body that is loaded into the offset slots 506 as a wedge to increase the friction force between the shoulders 212 and the housing body 106. For example, a combined thickness dimension 514 of the shoulders 212 and the retention insert 508 may be larger than a combined thickness dimension 516 of the contact slot 500 and the offset slot 506. Additionally, the width of the retention insert 508 may be larger than the width dimension 524 of the offset slot 506. The retention insert 508 is wedged between the shoulders 212 and the housing body 106 to secure the contacts 200 in the cavities 112 in a location that is proximate to the mounting side 108. The greater combined thickness of the shoulders 212 and the retention insert 508 and/or the width dimension 522 of the retention insert 508 may increase the force that is required to remove the contact 200 from the cavity 112 through the mounting side 108.

Figure 6:
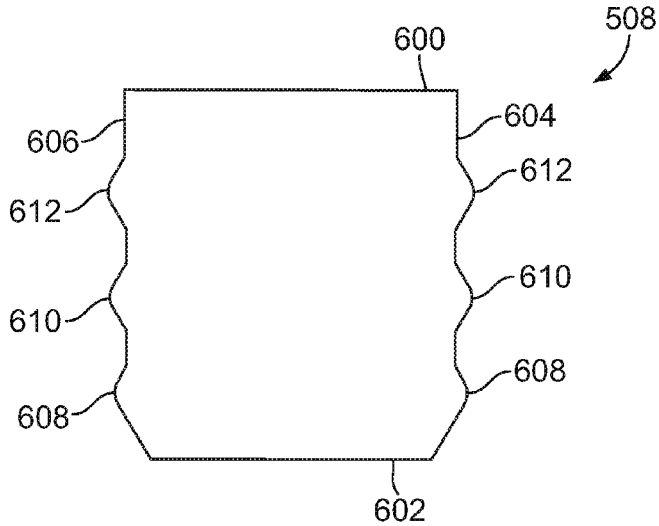
FIG. 6 is an elevational view of a retention insert which has been removed from the connector mounting side shown in FIG. 5.

FIG. 6 is an elevational view of the retention insert 508 in accordance with one embodiment. The retention insert 508 includes opposite ends 600, 602 and opposite sides 604, 606. Each of the sides 604, 606 includes retention bumps 608, 610, 612. The retention bumps 608-612 engage the housing body 106 (shown in FIG. 1) to secure the retention insert 508 in the housing body 106. For example, the retention bumps 608-612 may plow through and displace portions of the housing body 106 in the offset slot 506 to provide an interference fit that retains the retention insert 508 in the housing body 106. In the illustrated embodiment, the retention bumps 612 protrude from the sides 604, 606 by greater distances than the retention bumps 610 and the retention bumps 610 protrude from the sides 604, 606 by greater distances than the retention bumps 608. The retention insert 508 may be loaded into the offset slot 506 such that the end 600 is inserted into the offset slot 506 first. The larger retention bumps 612 may then plow through and displace enough of the housing body 106 within the offset slot 506 such that the retention bumps 608, 610 may engage the housing body 106 without having to displace a significant amount of the housing body 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a unitary housing body extending from a mounting side to an opposite mating side, the mating side configured to receive a contact pin of a mating connector through the mating side, the housing body comprising a cavity extending through the housing body from the mounting side to the mating side, a contact slot disposed at the mounting side, and a chamfered lead-in ramp disposed at the mating side to guide the contact pin into the cavity;

a stamped and formed contact held in the cavity and extending between a mating segment and a mounting segment along a longitudinal axis, the mating segment configured to receive the contact pin of the mating connector, the mounting segment configured to mount the contact to a circuit board and including a shoulder disposed proximate to the mounting side of the housing body, wherein the shoulder engages the housing body in the contact slot to secure the contact in the housing body; and a retention insert that is loaded into the cavity through the mounting side adjacent to the contact, wherein the retention insert and the contact are separate bodies.

2. The connector of claim 1, wherein the shoulder of the contact has a thickness dimension that is larger than a thickness dimension of the contact slot in the housing body to secure the contact in the housing body through an interference fit.

3. The connector of claim 1, wherein the housing body is a single piece body that is molded from a dielectric material.

4. The connector of claim 1, wherein the cavity is staged in diameter to form a plurality of stages between the mounting side and the mating side, further wherein, for each pair of stages that are adjacent to one another, an inside diameter of a first stage located closer to the mating side is less than an inside diameter of a second stage located closer to the mounting side.

5. The connector of claim 1, wherein the lead-in ramp circumferentially surrounds the cavity at the mating side.

6. The connector of claim 1, wherein the retention insert is wedged between the shoulders and the housing body to secure the contact in the cavity.

7. The connector of claim 1, wherein the cavity includes an offset slot to receive the retention insert, wherein a combined thickness dimension of the contact and the retention insert is larger than a combined thickness dimension of the contact slot and the offset slot.

8. The connector of claim 1, wherein the contact includes a hollow body encircling the longitudinal axis, further wherein the lead-in ramp of the housing body guides the contact pin along the longitudinal axis and into the hollow body.

9. The connector of claim 1, wherein the contact comprises a hollow body encircling the longitudinal axis with a seam extending along the longitudinal axis.

10. The connector of claim 1, wherein the contact is recessed within the cavity below the mating side of the housing body.

11. An electrical connector comprising:

a housing body extending from a mounting side to an opposite mating side, the mating side configured to receive a contact pin of a mating connector through the mating side, the housing body comprising a chamfered lead-in ramp disposed at the mating side; the housing body including a cavity extending through the housing body from the mating side to the mounting side and aligned with the lead-in ramp, the cavity staged in diameter to form a plurality of stages between the mounting side and the mating side such that, for each pair of the stages that are adjacent to one another, an inside diameter of a first stage located closer to the mating side is less than an inside diameter of a second stage located closer to the mounting side;

a contact held in the cavity, wherein the lead-in ramp guides the contact pin toward and into the contact to mate the contact with the contact pin; and a retention insert that is loaded into the cavity through the mounting side adjacent to the contact, wherein the retention insert and the contact are separate bodies.

12. The connector of claim 11, wherein the housing body is a unitary body molded from a dielectric material.

13. The connector of claim 11, wherein the lead-in ramp circumferentially surrounds the cavity at the mating side.

14. The connector of claim 11, wherein the contact is elongated along a longitudinal axis and includes shoulders extending from the contact in opposite directions, further wherein the retention insert is wedged between the shoulders and the housing body to secure the contact in the cavity.

15. The connector of claim 11, wherein the contact is elongated along a longitudinal axis, the contact comprising a hollow body encircling the longitudinal axis, further wherein the lead-in ramp of the housing body guides the contact pin along the longitudinal axis and into the hollow body.

16. The connector of claim 11, wherein the contact comprises a hollow body encircling a longitudinal axis with a seam extending along the longitudinal axis.

17. The connector of claim 11, wherein the contact is recessed within the cavity below the mating side of the housing body.

18. The connector of claim 11, wherein the lead-in ramp is angled toward a center axis of the cavity.

19. The connector of claim 11, wherein the cavity is staged in diameter to form a plurality of the pairs of the stages between the mounting side and the mating side such that, for each of the pair of the stages in the plurality of the pairs, the inside diameter of the first stage located closer to the mating side is less than the inside diameter of the second stage located closer to the mounting side.

* * * * *